US011577806B2

(12) United States Patent
Rozand et al.

(10) Patent No.: US 11,577,806 B2
(45) Date of Patent: Feb. 14, 2023

(54) MOTOR BOAT WITH FOILS WHICH ARE RETRACTABLE BY TILTING

(71) Applicant: Enata Investment Corporation Pte. Ltd., Singapore (SG)

(72) Inventors: Arthur Rozand, Sharjah (AE); Alaric Lukowski, Sharjah (AE); Stéphane Dyen, Sharjah (AE)

(73) Assignee: ENATA INVESTMENT CORPORATION PTE. LTD., Singapore (SG)

( * ) Notice: Subject to any disclaimer, the term of this patent is extended or adjusted under 35 U.S.C. 154(b) by 0 days.

(21) Appl. No.: 16/647,876

(22) PCT Filed: Sep. 12, 2018

(86) PCT No.: PCT/IB2018/056975
§ 371 (c)(1),
(2) Date: Mar. 17, 2020

(87) PCT Pub. No.: WO2019/064106
PCT Pub. Date: Apr. 4, 2019

(65) Prior Publication Data

US 2020/0247505 A1 Aug. 6, 2020

(30) Foreign Application Priority Data

Sep. 26, 2017 (EP) ..... 17193090

(51) Int. Cl.
*B63B 1/26* (2006.01)
*B63B 1/30* (2006.01)

(52) U.S. Cl.
CPC . *B63B 1/26* (2013.01); *B63B 1/30* (2013.01)

(58) Field of Classification Search
CPC ..... B63B 1/30; B63B 1/26; B63B 2001/281
See application file for complete search history.

(56) References Cited

U.S. PATENT DOCUMENTS 2,984,197 A * 5/1961 Bader ..... B63B 1/30 114/282
2,991,747 A 7/1961 Bader
(Continued)

FOREIGN PATENT DOCUMENTS

EP 2004479 12/2008
EP 2894090 7/2015
(Continued)

OTHER PUBLICATIONS

International Search Report dated Dec. 14, 2018 for Application No. PCT/IB2018/056975.
(Continued)

*Primary Examiner* — Andrew Polay
(74) *Attorney, Agent, or Firm* — Hamre, Schumann, Mueller & Larson, P.C.

(57) ABSTRACT

Motor boat comprising a support structure and at least one pair of similar foils arranged on each side of the support structure, each of said foils being defined by a wing and its support; the latter being retractable into the lower part of the structure and mounted so as to be slidable relative thereto; said foils being arranged so as to adopt at least two fixed positions, namely an "active" position in which they are deployed in similar positions and a "passive" position in which said supports are retracted into the support structure; characterized in that the boat is adapted such that the deployment of the foils comprises an initial movement of the supports in a substantially horizontal direction away from the vertical median plane of the support structure, followed by a tilting about an axis parallel or substantially parallel to the main axis of the boat.

6 Claims, 1 Drawing Sheet

(56) References Cited

U.S. PATENT DOCUMENTS

Figure 1:
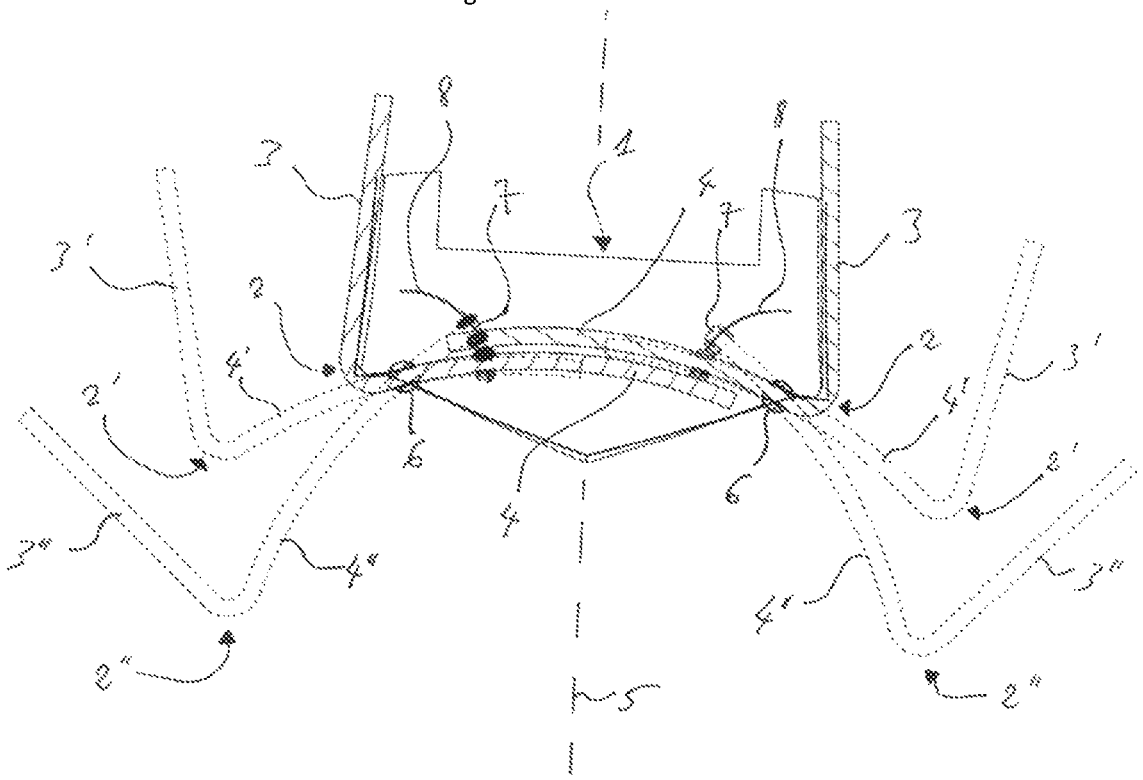

| | | | | |
|---|---|---|---|---|
| 3,081,728 | A | 3/1963 | Wilterdink et al. | |
| 3,099,239 | A * | 7/1963 | Von Schertel | B63B 1/30 114/282 |
| 3,150,626 | A | 9/1964 | Irgens | |
| 3,241,511 | A | 3/1966 | Drtina | |
| 3,345,968 | A | 10/1967 | Bailey | |
| 3,763,811 | A | 10/1973 | Danahy | |
| 4,058,076 | A | 11/1977 | anahy | |
| 4,237,810 | A | 12/1980 | Westfall | |
| 4,955,312 | A | 9/1990 | Magazzu | |
| 5,054,410 | A | 10/1991 | Scarborough | |
| 5,329,870 | A * | 7/1994 | Cook | B63B 1/28 114/279 |
| 5,988,097 | A | 11/1999 | Karney et al. | |
| 6,095,076 | A | 8/2000 | Nesbitt | |
| 6,499,419 | B1 | 12/2002 | Bussard | |
| 6,782,839 | B1 | 8/2004 | Nozaki | |
| 7,644,672 | B2 | 1/2010 | Welbourn | |
| 8,201,514 | B2 | 6/2012 | Cales | |
| 8,720,354 | B2 | 5/2014 | Ketterman et al. | |
| 8,967,063 | B2 | 3/2015 | Coffman | |
| 10,532,793 | B2 | 1/2020 | Lagarrigue et al. | |
| 2009/0013917 | A1 | 1/2009 | Ulgen | |
| 2012/0255479 | A1 | 10/2012 | Sahlin | |
| 2012/0325135 | A1 | 12/2012 | Ketterman et al. | |
| 2014/0109820 | A1 | 4/2014 | Kormann | |
| 2017/0036739 | A1 * | 2/2017 | Schnauffer | B63H 20/06 |

FOREIGN PATENT DOCUMENTS

| | | |
|---|---|---|
| EP | 3216689 | 9/2017 |
| KR | 20160000507 | 2/2016 |
| WO | WO 2016/009409 | 1/2016 |

OTHER PUBLICATIONS

International Written Oppinion dated Dec. 14, 2018 for Application No. PCT/IB2018/056975.

* cited by examiner

MOTOR BOAT WITH FOILS WHICH ARE RETRACTABLE BY TILTING

CROSS REFERENCE TO RELATED APPLICATIONS

The present application is a United States national stage application of International patent application PCT/IB2018/056975 filed on Sep. 12, 2018 designating the United States, and claims foreign priority to European patent application EP 17193090.2 filed on Sep. 26, 2017, the contents of both documents being herewith incorporated by reference in their entirety.

FIELD OF THE INVENTION

The present invention relates to motorized boats with foils.

PRIOR ART

The principle consisting in balancing the weight of a boat by a hydrodynamic lift effect produced by the speed of the water acting on elements in the form of wings that are submerged, semi-submerged or traverse the surface of the water, as opposed to using the Archimedean effect of submerged volumes alone, is relatively old. From the start of the twentieth century there have been motor boats equipped with this kind of device known as a foil. Additionally known is the use of foils with the aim of stabilizing vessels in terms of rolling or pitching in Archimedean configuration. The use of foils improves the performance of boats by increasing the speed and/or reducing energy consumption.

U.S. Pat. No. 4,237,810 discloses a motor boat equipped with foils.

In this boat, and more generally in motorized boats with foils, the position of the foils with respect to the bearing structure does not vary, whether the boat is at a standstill, is moving at a low or high speed or whether the force of the wind or the height of the waves is pronounced or not.

Other patents, such as U.S. Pat. No. 3,241,511, disclose principles of motor boats with foils with a system for the retractability of the foils by means of vertical sliding or by various rotation mechanisms. These systems make it possible in particular to relatively reduce the overall size and drag of the appendages when they are not used.

Patent application WO 2016/009409 discloses a principle making it possible to satisfy two precise distinct geometric configurations, namely (i) the coincidence with the shape of the hull of the foils in the raised position, and (ii) the positioning of the foils in the low position which makes it possible to naturally obtain the autostability of the hydrofoil in flight, be it in rolling or in pitching.

Patent application WO 2016/0094090 discloses a principle making it possible to satisfy two precise distinct geometric configurations, namely (i) the coincidence with the shape of the hull of the foils in the raised position, and (ii) the positioning of the foils in the low position which makes it possible to naturally obtain the autostability of the hydrofoil in flight, be it in rolling or in pitching.

However, the prior art devices do not allow the foils to be both above the waterline in the passive position, optimally integrated into the bearing structure, and sufficiently spaced apart in the active position, e.g. by at least twice the width of the boat. Such an arrangement would have the merit of increasing the natural stability of the boat while minimizing the overall size of the foils in the passive position.

DESCRIPTION OF THE INVENTION

The present invention notably offers the advantage of remedying the problem described in the previous chapter.

Generally speaking, it consists in initially deploying the foils along a substantially horizontal trajectory and then tilting them in the direction of the body of water.

The invention relates more precisely to a motor boat including a bearing structure and at least one pair of similar foils arranged one on each side of the bearing structure, each of said foils being defined by a wing and its support; the latter being retractable into the lower part of the structure and mounted so as to be slidable relative thereto; said foils being arranged so as to adopt at least two fixed positions, namely a position referred to as the "active" position in which they are deployed in similar positions and a position referred to as the "passive" position in which said supports are retracted into the bearing structure; characterized in that the boat is adapted so that the deployment of the foils comprises an initial displacement of the supports in a substantially horizontal direction which diverges from the vertical median plane of the bearing structure followed by tilting about an axis parallel or substantially parallel to the main axis of the boat.

By "substantially horizontal direction" must be understood a rectilinear trajectory that is horizontal or almost horizontal, a trajectory that is slightly curved but almost merges with a horizontal direction, or any other trajectory that is a projection of a horizontal direction.

It should be noted that the invention offers in particular the advantage of reducing the overall size of the foils as they can be positioned under the deck of the boat.

According to another embodiment of the invention, the foils are guided by two blocks that are adapted to allow the passage of sails of varying chord and twist. Advantageously, the system for mechanically raising the foils comprises a screw jack simultaneously secured to the bearing structure and to the foil.

Generally speaking, the mechanism for deployment of the foils described in the present patent application can be combined with all the other features described in the patent application WO 2016/009409, in particular the dynamic simulator.

The figure shows an embodiment in which the foils are similar but not symmetrically identical. The supports 4 are slightly asymmetrical so that in the passive position they can be stacked in the bearing structure 1. The figure illustrates three positions 2, 2',2" of the foils, i.e. the passive position 2, a transient position 2' and the active position 2".

In the passive position, the wings 3 merge with the side walls of the bearing structure 1.

In the active position, the distance between the ends of the wings 3" is at least equivalent to twice the width of the bearing structure 1.

During the deployment phase, the foils 2, 2',2" initially move along a slightly curved trajectory which diverges from the vertical median plane 5 of the bearing structure 1. There follows tilting of the foils 2',2" around an axis 6 directed in a direction parallel to the main axis of the boat. During this tilting, the free end 8 of each support 4 also undergoes rotation about the axis 6.

It goes without saying that the invention is not limited to the examples described and illustrated in this document. It covers any mechanism as defined in the claims allowing the position of the foils to be modified when sailing.

NUMERICAL REFERENCES USED IN THE FIGURE

1 Bearing structure
2 Foil in passive position
2' Foil in transient position
2" Foil in active position
3 Wing in passive position
3' Wing in transient position
3" Wing in active position
4 Support in passive position
4' Support in transient position
4" Support in active position
5 Vertical median plane
6 Tilt axis
7 Support fee end
8 Support free end trajectory

The invention claimed is:

1. A foil boat having a main axis in a driving direction comprising:

a boat hull; and a pair of foils arranged one on each side of the boat hull, each foil of the pair of foils including a wing and a support, wherein each support is slidable relative to the boat hull, and at least partially retractable into the boat hull, such that the pair of foils are configured to adopt a first, active position where the pair of foils are deployed in similar positions, and a second, passive position in which each support is at least partially retracted into the boat hull, and wherein a displacement of the pair of foils from the second, passive position to the first active position includes an initial sliding displacement of each support in a direction away from the boat hull, the direction diverging from a vertical median plane of the boat hull, followed by rotation motion about an axis that is parallel or substantially parallel to the main axis of the foil boat, such that an angle of the wings increase relative to the vertical median plane to move the wings closer to a horizontal position, wherein the pair of the foils are deployed asymmetrically.

2. A foil boat having a main axis in a driving direction comprising:

a boat hull; and a pair of foils arranged one on each side of the boat hull, each foil of the pair of foils including a wing and a support, wherein each support is slidable relative to the boat hull, and at least partially retractable into the boat hull, such that the pair of foils are configured to adopt a first, active position where the pair of foils are deployed in similar positions, and a second, passive position in which each support is at least partially retracted into the boat hull, and wherein a displacement of the pair of foils from the second, passive position to the first, active position includes an initial sliding displacement of each support in a direction away from the boat hull, the direction diverging from a vertical median plane of the boat hull, followed by rotation motion about an axis that is parallel or substantially parallel to the main axis of the foil boat, such that an angle of the wings increase relative to the vertical median plane to move the wings closer to a horizontal position, wherein the direction of the initial sliding displacement away from the boat hull forms a curved trajectory.

3. The foil boat as claimed in claim 1, wherein in the second, passive position, each wing is arranged to be parallel to a side wall of the boat hull.

4. A method for deploying the pair of foils of the foil boat as defined in claim 1, including the steps of:

initially displacing each support away from the boat hull in the direction that diverges from the vertical median plane of the boat hull; and rotating each one of the pair of foils about an axis that is parallel or substantially parallel to the main axis of the foil boat.

5. A foil boat having a main axis in a driving direction comprising:

a boat hull; and a pair of foils arranged one on each side of the boat hull, each foil of the pair of foils including a wing and a support, wherein each support is slidable relative to the boat hull, and at least partially retractable into the boat hull, such that the pair of foils are configured to adopt a first, active position where the pair of foils are deployed in similar positions, and a second, passive position in which each support is at least partially retracted into the boat hull, and wherein a displacement of the pair of foils from the second, passive position to the first, active position includes an initial sliding displacement of each support in a direction away from the boat hull, the direction diverging from a vertical median plane of the boat hull, followed by rotation motion about an axis that is parallel or substantially parallel to the main axis of the foil boat, such that an angle of the wings increase relative to the vertical median plane to move the wings closer to a horizontal position, wherein the support of each one of the foils has a curved shape, and the direction of the initial sliding displacement of the support away from the boat hull forms a curved trajectory along the curved shape of the support.

6. A foil boat having a main axis in a driving direction comprising:

a boat hull; and a pair of foils arranged one on each side of the boat hull, each foil of the pair of foils including a wing and a support, wherein each support is slidable relative to the boat hull, and at least partially retractable into the boat hull, such that the pair of foils are configured to adopt a first, active position where the pair of foils are deployed in similar positions, and a second, passive position in which each support is at least partially retracted into the boat hull, and wherein a displacement of the pair of foils from the second, passive position to the first, active position includes an initial sliding displacement of each support in a direction away from the boat hull, the direction diverging from a vertical median plane of the boat hull, followed by rotation motion about an axis that is parallel or substantially parallel to the main axis of the foil boat, such that an angle of the wings increase relative to the vertical median plane to move the wings closer to a horizontal position, wherein the support is not movable relative to the wing of each one of the foils.

* * * * *